US007237621B2

(12) United States Patent
Hsieh

(10) Patent No.: US 7,237,621 B2
(45) Date of Patent: Jul. 3, 2007

(54) DRIVING DEVICE

(76) Inventor: Chih-Ching Hsieh, 235 Chung-Ho Box 8-24, Taipei (TW)

( * ) Notice: Subject to any disclaimer, the term of this patent is extended or adjusted under 35 U.S.C. 154(b) by 76 days.

(21) Appl. No.: 11/006,223

(22) Filed: Dec. 7, 2004

(65) Prior Publication Data

US 2006/0131041 A1 Jun. 22, 2006

(51) Int. Cl.
*B25B 21/00* (2006.01)

(52) U.S. Cl. ..... 173/104; 173/93.5; 173/109; 173/111; 81/57

(58) Field of Classification Search ..... 173/104, 173/93.5, 110, 111, 109.94, 47, 48, 171; 81/57, 81/DIG. 2, 463–466, 57.12, 57.13, 57.28, 81/57.29, 57.45, 57.46
See application file for complete search history.

(56) References Cited

U.S. PATENT DOCUMENTS 1,141,650 A * 6/1915 Oldham ..... 173/111
2,119,968 A * 6/1938 Shaff ..... 81/57.39
2,264,012 A * 11/1941 Wasson ..... 81/57.39
3,083,598 A * 4/1963 Kinnison ..... 81/124.3
3,478,829 A * 11/1969 Bixby ..... 173/104
4,319,646 A * 3/1982 Emonet ..... 173/111
5,826,609 A * 10/1998 Watts ..... 137/15.17
6,216,562 B1 * 4/2001 Hsieh ..... 81/57.29
6,370,993 B1 * 4/2002 Pitstick ..... 81/463
6,502,485 B1 * 1/2003 Salazar ..... 81/463
2005/0279196 A1 * 12/2005 Hollar ..... 81/464

* cited by examiner

*Primary Examiner*—John Sipos
*Assistant Examiner*—Michelle Lopez

(57) ABSTRACT

A driving unit comprises a pneumatic head for being combined to a pneumatic tool; a front end of the pneumatic head being installed with a push rod; a driving unit having a slender driving rod at a front end thereof; the push rod serving to push the driving unit; an elastomer; a casing having a receiving space; the elastomer being received in an upper end of the receiving space; and the driving unit being received in an upper end of the receiving space and resisting against the elastomer; a rotating unit having an engaging portion at a lower end thereof; the rotating unit being received in a lower end of the receiving space; and an upper side of the rotating unit having a contact portion; the configuration of the contact portion being corresponding to one end portion of the driving unit.

2 Claims, 8 Drawing Sheets

DRIVING DEVICE

FIELD OF THE INVENTION

The present invention relates to driving devices, and in particular a driving device for converting liner motions of a pneumatic tool into circular motions.

BACKGROUND OF THE INVENTION

In the prior art, a sleeve is used to engage with a screw means and then a spanner serves to drive the sleeve by applying a force-to the spanner. However this prior art way is not effective and can not provide a stable operation to users.

SUMMARY OF THE INVENTION

Accordingly, the primary object of the present invention is to provide a driving device for converting a liner motion of a pneumatic tool in circular motion.

To achieve above objects, the present invention provides a driving unit. The driving unit comprises a pneumatic head for being combined to a pneumatic tool; a front end of the pneumatic head being installed with a push rod; a driving unit having a slender driving rc d at a front end thereof; the push rod serving to push the driving unit; an elastomer; a casing having a receiving space; the elastomer being received in an upper end of the receiving space; and the driving unit being received in an upper end of the receiving space and resisting against the elastomer; a rotating unit having an engaging portion at a lower end thereof; the rotating unit being received in a lower end of the receiving space; an upper side of the rotating unit having a contact portion; the configuration of the contact portion being corresponding to one end portion of the driving unit; wherein when the teeth portion of the rotating unit resists against the oblique end surface of the driving rod, the rotating unit gets a rotating force for driving the engaging portion. When the driving unit is impacted by the pneumatic head, the driving unit will move downwards; and the driving rod will drive the rotating unit. When no force is applied to the driving unit, the driving unit will restore to an original place by the elastomer.

The various objects and advantages of the present invention will be more readily understood from the following detailed description when read in conjunction with the appended drawing.

DETAILED DESCRIPTION OF THE INVENTION

In order that those skilled in the art can further understand the present invention, a description will be described in the following in details. However, these descriptions and the appended drawings are only used to cause those skilled in the art to understand the objects, features, and characteristics of the present invention, but not to be used to confine the scope and spirit of the present invention defined in the appended claims.

Figure 1:
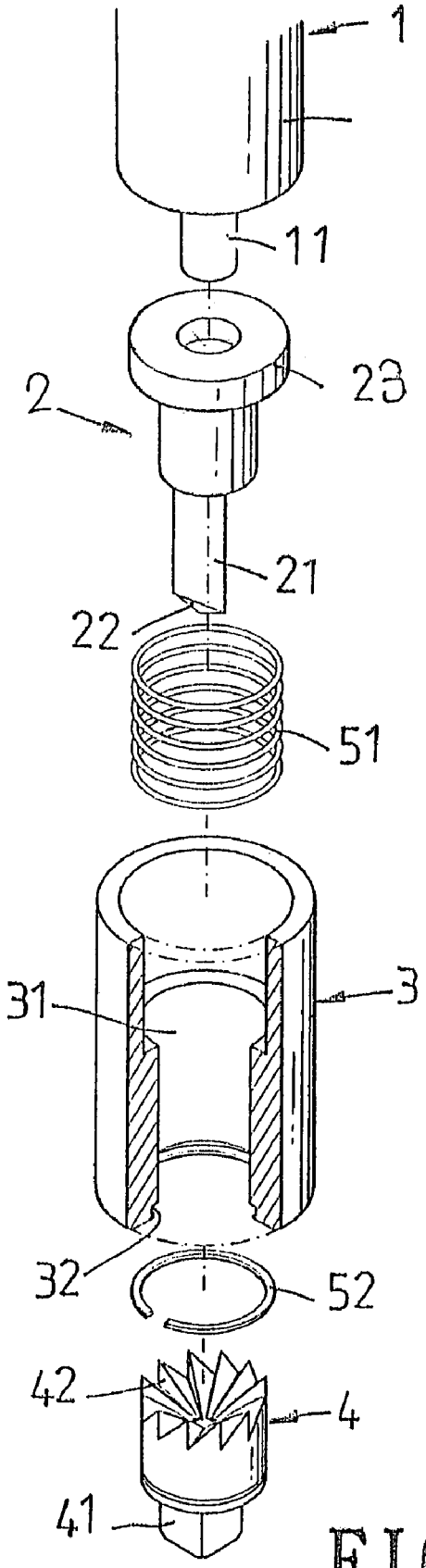
FIG. 1 is an exploded perspective view of the driving device of the present invention.
Figure 2:
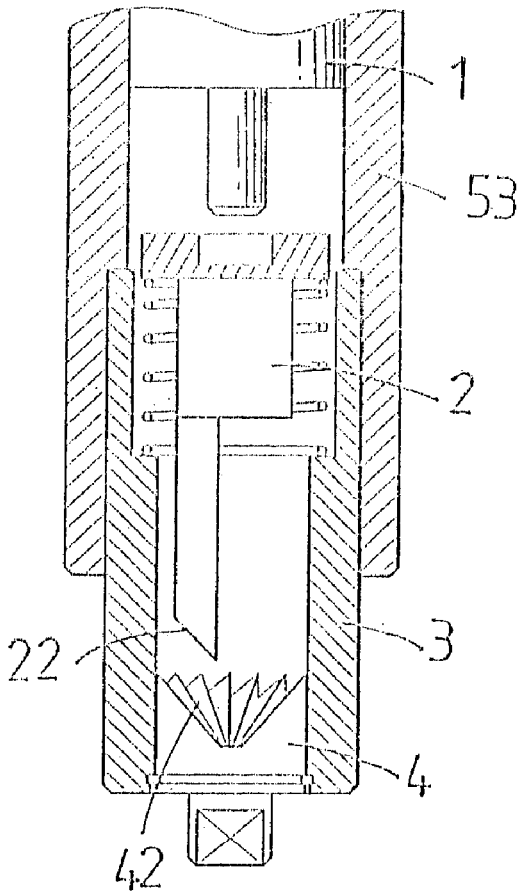
FIGS. 2 and 3 are schematic views about the driving device of the present invention.
Figure 3:
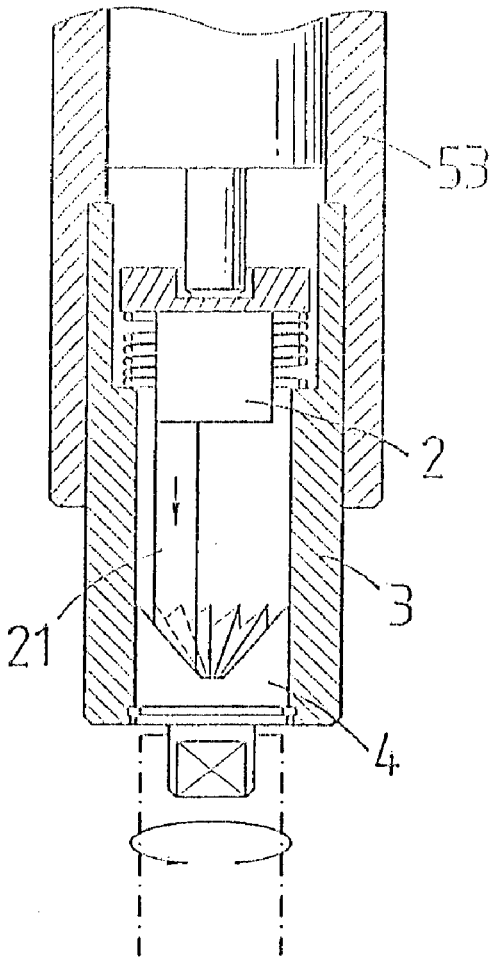

Referring to FIGS. 1 to 3, the driving device of the present invention is illustrated. The driving unit 2 has the following elements.

A pneumatic head 1 serves to be combined to a pneumatic tool. It is driven by the pneumatic tool to push forwards reciprocally (this is known in the prior art, and thus the details will not be further described herein). A front end of the pneumatic head 1 is installed with a push rod 11.

A driving unit 2 has a large upper ring 22 and a slender driving rod 21 at a front end thereof. A center of the upper ring 22 has a recess for receiving the push rod 11. The push rod 11 serves to push the driving unit 2. A front end of the driving rod 21 has an oblique top surface 22.

A round cylindrical casing 3 has a receiving space 31. An inner diameter of an upper end of the receiving space 31 is greater than that of a lower end of the teeth portion 42. The upper end and lower end of the receiving space 31 are formed as a stepped structure. The upper end is formed as a smaller straight round inner cylinder and the lower end is formed as a greater straight round inner cylinder. The driving unit 2 can be received in the upper end of the receiving space 31. The lower side of the receiving space 31 has an annular recess 32 near the bottom end of the receiving space 31.

A rotating unit 4 has an engaging portion 41 at a lower end thereof. The rotating unit 4 is received in the lower end of the receiving space 31. The engaging portion 41 serves to combine with a sleeve or other screwing means. An upper side of the rotating unit 4 has a teeth portion 42. A plurality of teeth of the teeth portion 42 are annularly arranged around the upper side of the rotating unit 4. The configuration of the teeth portion 42 is corresponding to the oblique end surface 22 of the driving unit 2. When the teeth portion 42 of the rotating unit 4 resists against the oblique end surface 22 of the driving rod 21, the rotating unit 4 gets a rotating force for driving the engaging portion 41 and the sleeve or screwing means thereon.

A spring 51 is included.

A C ring 52 is also included.

In assembly of the present invention, the C ring 52 is installed in the annular recess 32 of the casing 3. The rotating unit 4 is installed into the lower end of the receiving space 31 of the casing 3. The spring 51 is installed into the upper end of the receiving space 31. The driving unit 2 is placed into the receiving space 31 so that the driving unit 2 resists against the spring 51. When no force is applied to the driving unit 2, the driving unit 2 will be pushed back to an upper place of the upper end of the receiving space 31. Finally, the casing 3 is combined to a mouth 53 at a front end of a pneumatic tool.

When the pneumatic head 1 is pushed by the push rod 11, the oblique end surface 22 of the driving rod 21 resists against the teeth portion 42 of the rotating unit 4. Then the teeth portion 42 will rotate. When the pneumatic tool stops to supply impact force to the pneumatic head 1, the driving unit 2 will be pushed back by the elastic force so that the driving unit 2 is pushed back to the upper end of the receiving space 31. Then, the oblique end surface 22 of the driving rod 21 separates from the teeth portion 42 of the rotating unit 4. When the pneumatic tool supplies impact force to the pneumatic head 1 reciprocally, the rotating unit 4 will rotate continuously. Thereby the linear motion of the pneumatic tool will be converted into circular motion so that the engaging portion 41 at the front end of the rotating unit 4 drives the sleeve or the screwing means.

Figure 4:
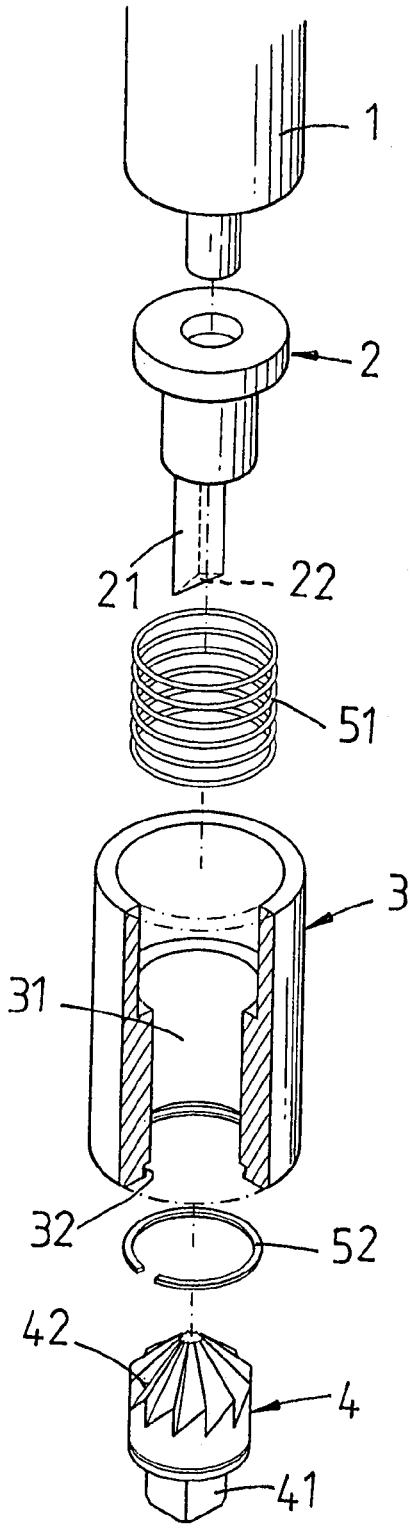
FIG. 4 is an exploded perspective view of the second embodiment of the present invention.
Figure 5:
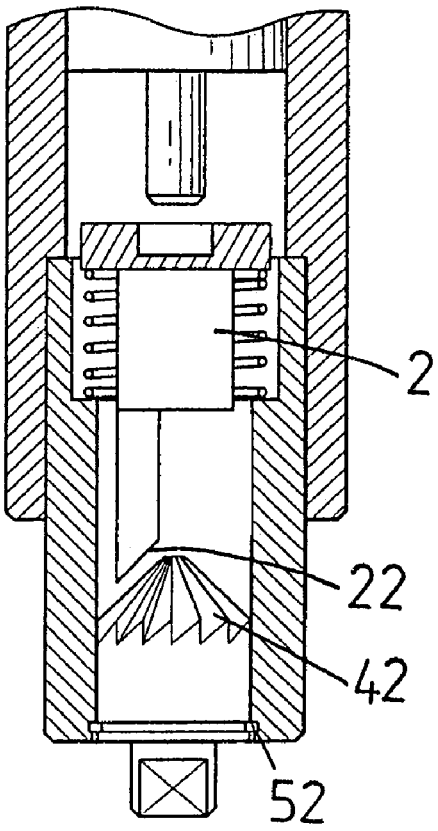
FIGS. 5 and 6 are cross sectional views showing the operation of the second embodiment of the present invention.
Figure 6:
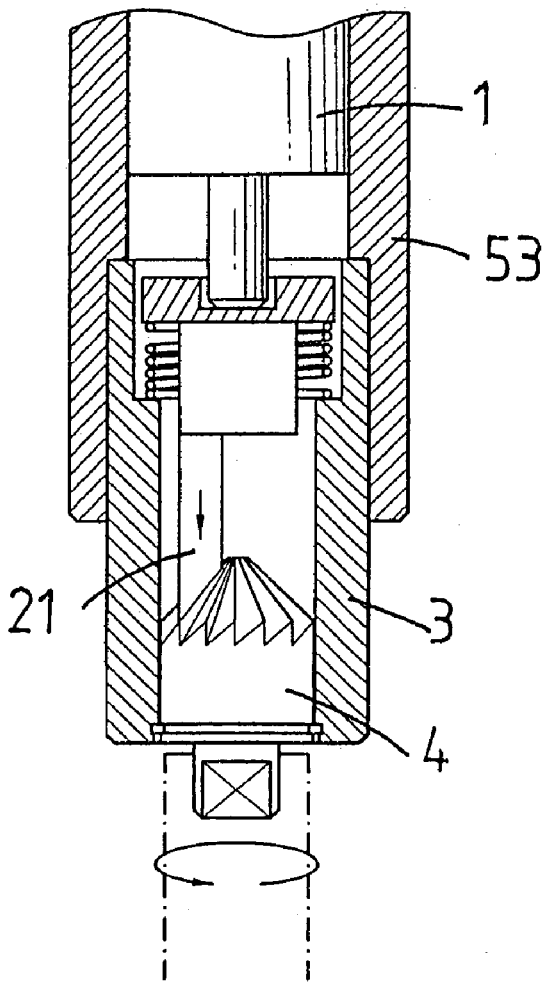
Figure 7:
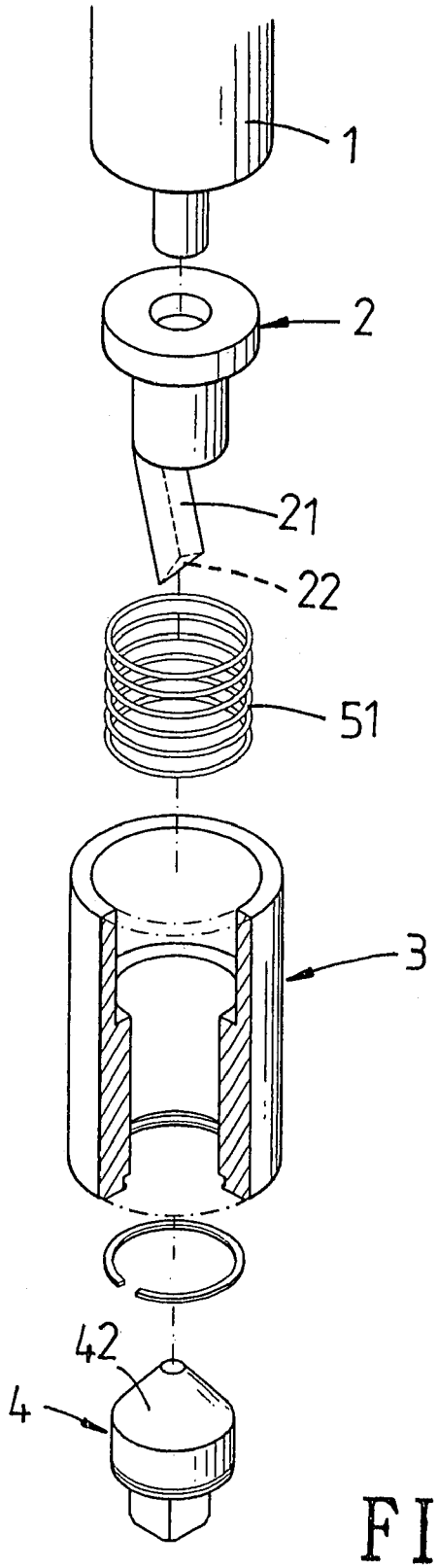
FIG. 7 is an exploded perspective view about the third embodiment of the present invention.
Figure 8:
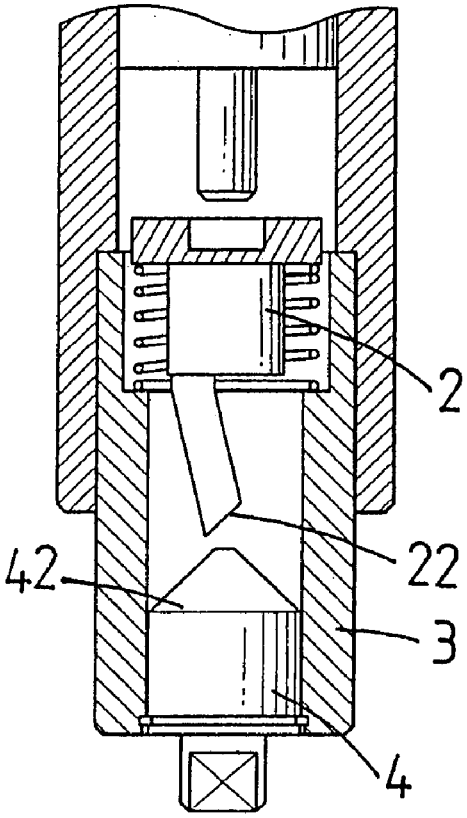
FIGS. 8 and 9 are cross sectional views about the third embodiment of the present invention, where the operation of the embodiment is illustrated.
Figure 9:
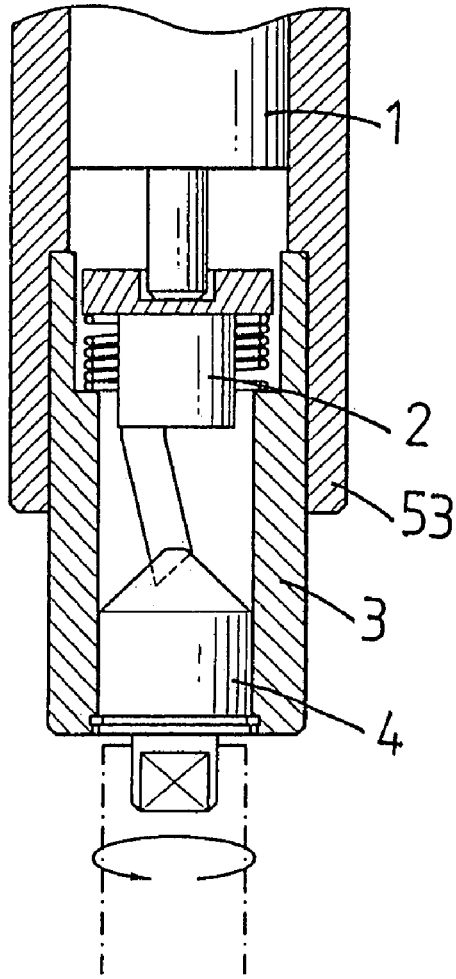
Figure 10:
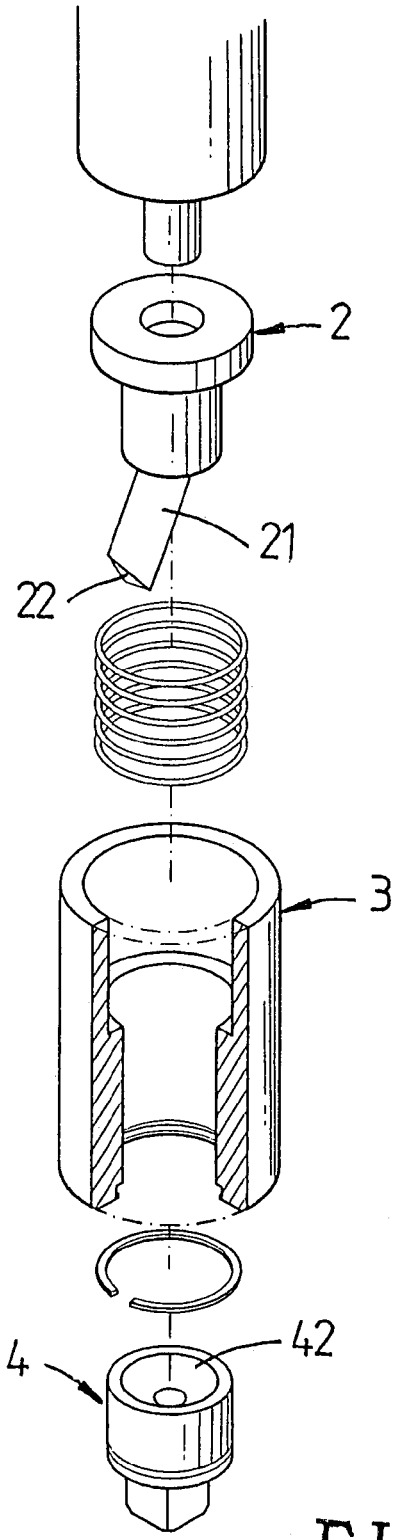
FIG. 10 is an exploded schematic view about the fourth embodiment of the present invention.
Figure 11:
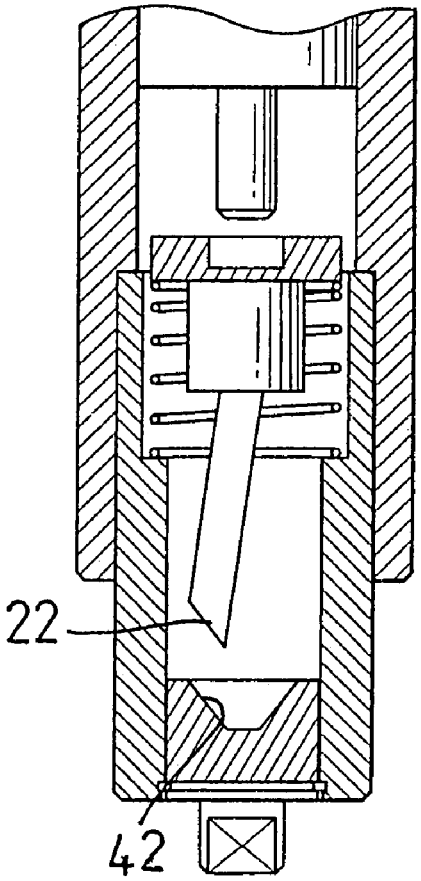
FIGS. 11 and 12 show the cross sectional views about the operation of the fourth embodiment of the present invention.
Figure 12:
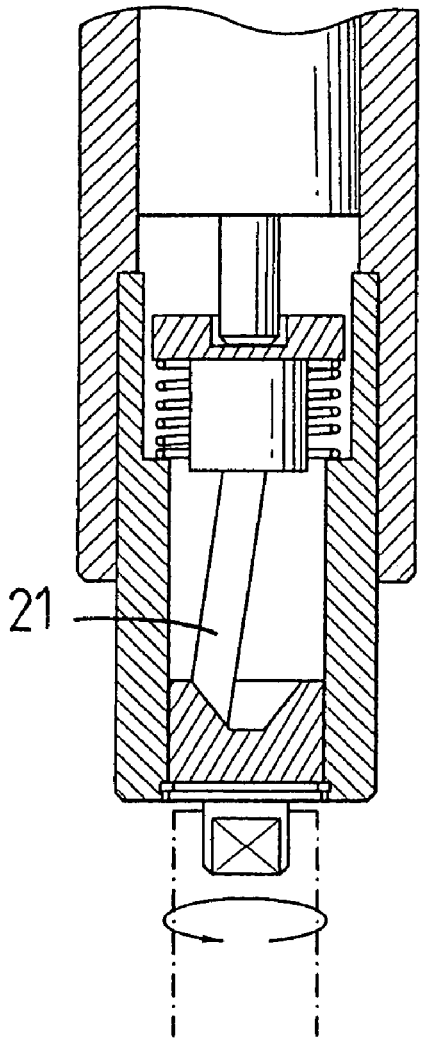

In the present invention, see FIGS. 1 to 3, the teeth portion 42 of the rotating unit 4 is concave at a center portion of the top of the rotating unit 4, or see FIGS. 4 to 6, is convex at a center portion of the top of the rotating unit 4. Besides other shapes are desired.

Referring to FIGS. 7 to 12, the third and fourth embodiments of the driving unit of the present invention are illustrated. Those same as the former embodiments are not described herein. Only the differences are described. To simplify the manufacturing process of the driving device, the teeth portion 42 of the rotating unit 4 can be replaced by a round tapered surface 43 and the driving rod 21 of the driving unit 2 has an oblique end surface 22. When the driving rod 21 moves downwards, it will pass through the round tapered surface 43 so as to drive the rotating unit 4.

In the present invention, the round tapered surface 43 may be a convex surface which is protruded from the center of the top surface of the rotating unit 4 (referring to FIG. 7 to 9) or a concave surface which is concave from the center of the top surface of the rotating unit 4. Or the round tapered surface has other configurations. All these are within the scope of the present invention.

The present invention is thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A driving device comprising:

a pneumatic head (1) connected to a pneumatic tool; the pneumatic head (1) being driven by the pneumatic tool to push forwards reciprocally; a front end of the pneumatic head (1) being installed with a push rod (11);

a driving unit (2) having a large upper ring (23) and a slender driving rod (21) at a front end thereof; a center of the upper ring 23 having a recess for receiving the push rod (11); the push rod (11) serving to push the driving unit (2); a front end of the driving rod (21) having an oblique top surface (22);

a round cylindrical casing (3) having a receiving space (31); an inner diameter of an upper end of the receiving space (31) being greater than that of a lower end of a teeth portion (42); the upper end and a lower end of the receiving space (31) being formed as a stepped structure; the upper end being formed as a smaller straight round inner cylinder and the lower end being formed as a greater straight round inner cylinder; the driving unit (2) being received in the upper end of the receiving space (31); a lower side of the receiving space (31) having an annular recess (32) near a bottom end of the receiving space (31);

a rotating unit (4) having an engaging portion (41) at a lower end thereof; the rotating unit (4) being received in the lower end of the receiving space (31); the engaging portion (41) serving to combine with a sleeve or other screwing means; an upper side of the rotating unit (4) having a teeth portion (42); a plurality of teeth of the teeth portion (42) being annularly arranged around the upper side of the rotating unit (4); the configuration of the teeth portion (42) being corresponding to an oblique end surface (22) of the driving unit (2); when the teeth portion (42) of the rotating unit (4) resists against the oblique end surface (22) of the driving rod (21), the rotating unit (4) having a rotating force for driving the engaging portion (41) and the sleeve or screwing moans thereon; a spring (51) enclosing a middle part of a driving unit (2);

wherein the pneumatic head (1), the upper ring (23) of the driving unit (2), the casing (3), an upper end of the rotating unit (4) and the spring (5) are coaxial round cylinders; and wherein in assembly, the rotating unit (4) being installed into a lower end of the receiving space (31) of the casing (3), the spring (51) being installed into the upper end of the receiving space (31), the driving unit (2) being placed into the receiving space (31) so that the driving unit (2) resists against the spring (51) and when no force being applied to the driving unit (2) the driving unit (2) will be pushed back to an upper place of the upper end of the receiving space (31).

2. A driving device as claimed in claim 1, wherein a C ring (52) is installed in the annular recess (32) of the casing (3).

* * * * *